US005241349A

United States Patent [19]

Nagasaka

[11] Patent Number: 5,241,349

[45] Date of Patent: Aug. 31, 1993

[54] IMAGE FORMING APPARATUS HAVING A PLURALITY OF CONTROL MODES OF THERMAL FIXING APPARATUS

[75] Inventor: Toshio Nagasaka, Iruma, Japan

[73] Assignees: Casio Computer Co., Ltd.; Casio Electronics Manufacturing Co., Ltd., both of Tokyo, Japan

[21] Appl. No.: 833,159

[22] Filed: Feb. 10, 1992

[30] Foreign Application Priority Data

Mar. 12, 1991 [JP] Japan ..... 3-46556

[51] Int. Cl.[5] ..... G03G 15/20

[52] U.S. Cl. ..... 355/285; 355/208; 219/216; 118/60; 432/60

[58] Field of Search ..... 355/206, 208, 282, 285; 219/216, 388; 432/60; 118/60; 346/160.1, 157, 160

[56] References Cited

U.S. PATENT DOCUMENTS

| | | | |
|---|---|---|---|
| 4,375,917 | 3/1983 | Hiraike et al. . | |
| 4,609,278 | 9/1986 | Taniguchi | 219/216 X |
| 4,618,245 | 10/1986 | Fukushi . | |
| 4,627,714 | 12/1986 | Nozaki | 432/60 X |
| 4,671,643 | 6/1987 | Shigemura . | |
| 4,821,069 | 4/1989 | Kusumoto | 219/216 X |
| 4,878,092 | 10/1989 | Arai | 355/285 |
| 4,996,567 | 2/1991 | Watarai et al. | 355/208 |
| 5,049,906 | 9/1991 | Kobayashi et al. | 346/160.1 |
| 5,051,780 | 9/1991 | Stelter et al. | 355/285 X |
| 5,073,799 | 12/1991 | Watanabe | 355/285 |
| 5,081,493 | 1/1992 | Miyasaka | 355/208 |

FOREIGN PATENT DOCUMENTS

| | | | |
|---|---|---|---|
| 53-141045 | 12/1978 | Japan | 355/285 |
| 58-105272 | 6/1983 | Japan | 355/285 |
| 60-73559 | 4/1985 | Japan | 355/208 |

*Primary Examiner*—Richard L. Moses
*Attorney, Agent, or Firm*—Nixon & Vanderhye

[57] ABSTRACT

An image forming apparatus comprises a thermal fixing apparatus having a heat generating member and heat-fixing an image on paper, a section for discriminating a using frequency of the image forming apparatus, and a section for controlling a fixing temperature having a first temperature control mode maintaining the temperature of the thermal fixing apparatus to be a first temperature at which the image can be fixed, a second temperature control mode maintaining the temperature of the thermal fixing apparatus to be a second temperature, which is lower than the first temperature by a predetermined temperature, and a third temperature control mode stopping current supply to a heat generating member of the thermal fixing apparatus. Moreover, the fixing temperature control section selects either the second control mode or the third control mode in accordance with an output of the using frequency discriminating section when a non-image forming operation period continues for a predetermined period of time while the fixing temperature control section is operating in the first temperature mode.

12 Claims, 9 Drawing Sheets

IMAGE FORMING APPARATUS HAVING A PLURALITY OF CONTROL MODES OF THERMAL FIXING APPARATUS

BACKGROUND OF THE INVENTION

1. Field of the Invention

The present invention relates to an image forming apparatus and more particularly to an image forming apparatus having a plurality of control modes for controlling a temperature of a thermal fixing apparatus and automatically selecting a corresponding control mode in accordance with a frequency of an image forming operation.

2. Description of the Related Art

In the conventional PPF (Plain Paper Facsimile), there has been known an apparatus for reducing the rate of operation of a heater for a thermal fixing apparatus so as to save power consumption and controlling a temperature of the thermal fixing apparatus to be lower than a printable temperature as the so-called sleep mode if time for which the facsimile does not receive a signal from an external unit continues for a predetermined period of time, that is, time when no printing operation for received data is performed continues for a predetermined period of time.

On the other hand, there has been known an apparatus in which the current supply to the heater for the thermal fixing apparatus is stopped, so that consumption power is largely saved and a current supply return operation is performed by inputting a receiving signal if the state that no signal is sent from the external unit continues for a predetermined period of time.

However, in the apparatus controlling the heater for the thermal fixing apparatus in the above-mentioned sleep mode and reducing the rate of operation of the heater for the thermal fixing apparatus, at night when the frequency of receiving is extremely low, current supply to the heater for the thermal fixing apparatus itself is that electrical power is wastefully consumed. Even if the heater is controlled in the sleep mode, this does not change the fact that current supply is always performed. Due to this, the lifetime of the thermal relating members such as a thermal fixing roll and a heater is shortened.

Moreover, in the control of stopping the current supply to the heater for the fixing device when no signal is supplied for a predetermined time, there are problems in that it takes a long time till the thermal fixing roll is stabilized and the fixing operation can be performed, that is, rise time (warm-up time), and a printing process cannot be performed at the same time with receiving the signal. In order to solve these problems, there can be used a process in which a memory may be provided in the facsimile and received data is once stored in the memory, and data is read out from the memory and a printing operation is performed when the temperature of the fixing device reaches to the temperature at which the fixing device can be fixed. However, in this case, the memory having extremely large capacities is needed in the facsimile apparatus, so that the manufacturing cost of the apparatus is increased.

In order to prevent the increase in the manufacturing cost of the apparatus, there is an apparatus in which a transmitting signal from an opponent is waited till receiving data becomes printable without providing the memory. However, the facsimile cannot be effectively used.

SUMMARY OF THE INVENTION

An object of the present invention is to provide an image forming apparatus in which lifetime of thermal relating members can be prolonged without wasting power and a printing process can be performed right after receiving data.

In order to attain the above object, the image forming apparatus of the present invention comprises a thermal fixing apparatus having a heat generating member for heat-fixing an image on paper, means for discriminating a using frequency of the image forming apparatus, means for controlling a fixing temperature having a first temperature control mode maintaining the temperature of the thermal fixing apparatus to be a first temperature at which the image can be fixed, a second temperature control mode maintaining the temperature of the thermal fixing apparatus to be a second temperature, which is lower than the first temperature by a predetermined temperature, and a third temperature control mode stopping current supply to a heat generating member of the thermal fixing apparatus, wherein the fixing temperature control means selects either the second control mode or the third control mode in accordance with an output of the using frequency discriminating means when a non-image forming operation period continues for a predetermined period of time while the fixing temperature control means is operating in the first temperature mode.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

One embodiment of the present invention will be explained with reference to the drawings.

Figure 2:
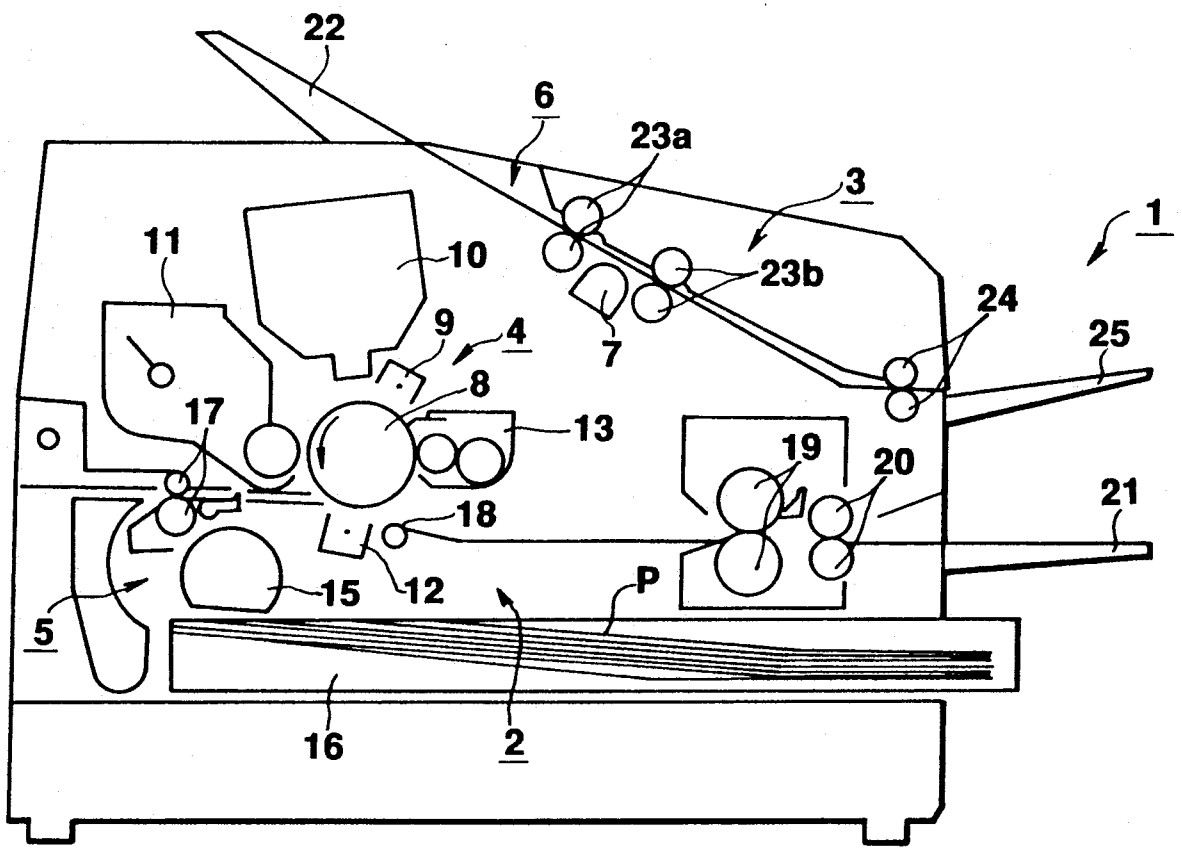
FIG. 2 shows a general structural view of the facsimile of one embodiment of the present invention.

This embodiment explains a facsimile as an example of an image forming apparatus. FIG. 2 shows a general structural view of the facsimile. In the drawing, a facsimile 1 comprises a receiving data printing section 2, a transmitting data reading section 3, and a transmitting and receiving control section (not shown) converting data received via a communication line (telephone line) to printing data, outputting printing data to the receiving data printing section 2, or converting data read by the transmitting data reading section 3 to transmitting data and outputting transmitting data to the communication line.

The receiving data printing section 2 comprises an image forming section 4 and a paper feeding mechanism 5. The image forming section 4 is an apparatus for printing on a paper P based on printing data output from the transmitting and receiving control section. The image forming section 4 comprises a photosensitive drum 8, a charger 9 arranged close to the photosensitive drum 8, a printing head 10, a developing apparatus 11, a transfer apparatus 12, and a cleaner 13. Printing data (dot patterned data) output from the transmitting and receiving control section is supplied to the printing head 10, and an optical writing is performed on the photosensitive drum 8 to which uniform electrical charge is applied based on printing data, thereby an electrostatic latent image is formed. The toner development of the electrostatic latent image is made by the developing apparatus 11, and transferred to paper P to be fed via the paper feeding mechanism 5 by the transfer apparatus 12.

The paper feeding mechanism 5 comprises a feeding roller 17 feeding paper P, which was delivered from a feeding cassette 16 by the rotation of a paper feed roller 15, to the transferring section, a transferring roller 18 transferring the paper on which the toner image is transferred to a fixing roll 19 having a heat generating member from the transferring section, and a delivering roller 20 delivering the paper P, which is thermally fixed by the fixing roll, to the outside of the apparatus. The paper P, which was delivered to the outside of the apparatus, is mounted on a tray 21.

The transmitting data reading section 3 comprises a transmitting paper transferring mechanism 6 and a transmitting data reading head 7. The transmitting paper transferring mechanism 6 comprises a plate 22 for a document in which transmitting data is described, transferring rollers 23*a* and 23*b*, and a delivering roller 24. The transferring rollers 23*a* and 23*b* are controlled to be rotated in accordance with a control signal to be output from a central processing unit to be explained later, thereby transferring the document. Data in the document is read by the transmitting data reading head 7. The document in which data is read by the transmitting data reading head 7 is delivered to a tray 25 by the delivering roller 24. The transmitting data reading head 7 has a line-shape CCD sensor in its inside, and outputs read document data to the transmitting and receiving control section. The transmitting and receiving control section converts document data to be input to a transmitting code, and transmits the converted data to an opponent via a telephone line.

Figure 3:
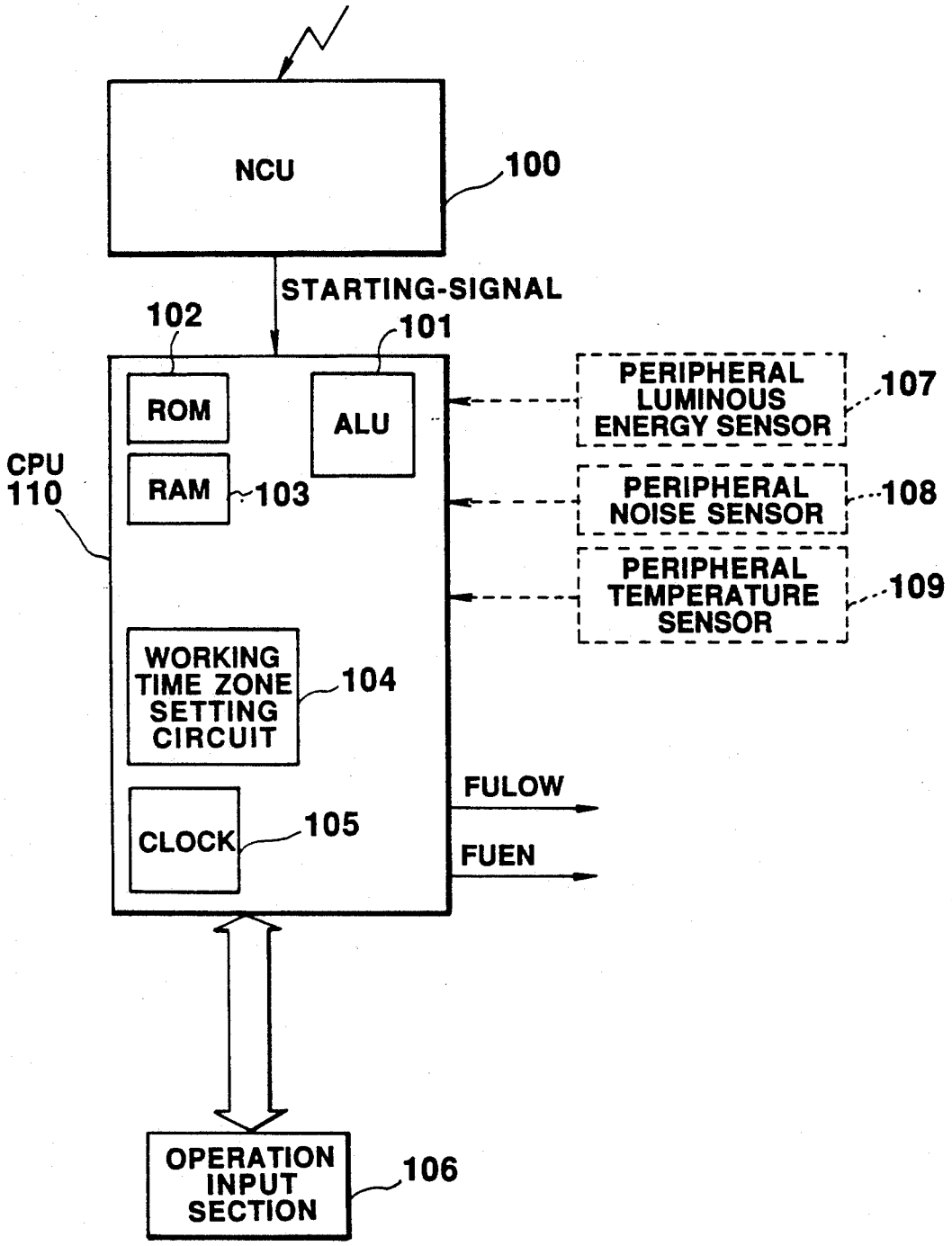
FIG. 3 is a view showing a central processing unit (CPU) controlling the entire operation of the facsimile.

FIG. 3 shows a central processing unit 110 (hereinafter called CPU) discriminating a using frequency of the facsimile apparatus, and totally controlling the operation of the whole apparatus such as the receiving data printing section 2, the transmitting data reading section 3, and the transmitting and receiving section. CPU 110 comprises a ROM 102 (Read Only Memory) storing programs for processing the operation control of the whole apparatus and the relating constants, a RAM 103 (Random Access Memory) storing data randomly accessing and an ALU 101 (Arithmetic Logic Unit) such as a microprocessor processing in accordance with the program stored in the ROM 102. For example, CPU 110 processes the corresponding program based on a signal from each sensor such as a peripheral luminous energy sensor 107, a peripheral noise sensor 108, and a peripheral temperature sensor 109 and a signal to be input from the other control units such as a network control unit (NCU) 100. Thereby, CPU 110 calculates the operation of a suitable load, and sequentially outputs an instruction signal for operation of a necessary load (for example, FULOW, FUEN to be explained later).

Moreover, CPU 110 stores high (or low) using frequency time zone data of the apparatus, which is designated and input from an operation input section 106, in a working time zone setting circuit 104. Similarly, CPU 110 reads high (or low) using frequency time zone data corresponding to communication area data, which is designated and input from the operation input section 106, from the ROM 102 and sets data in the working time zone setting circuit 104. Furthermore, CPU 110 compares time data output by a clock 105 counting the present time with time zone data set in the working time zone setting circuit 104, and discriminates whether the fixing roll 19 is controlled at a normal temperature, or a temperature lower than the normal temperature, or the current supply to the fixing roller 19 is stopped.

Figure 1:
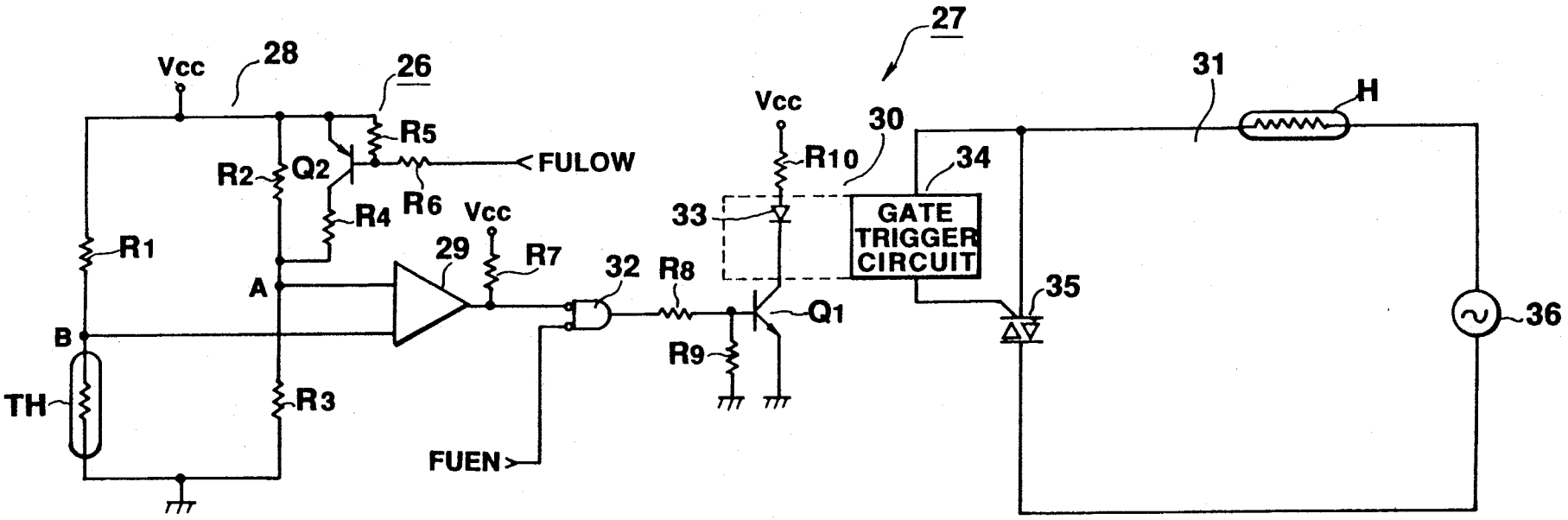
FIG. 1 shows a temperature control circuit of a fixing roll in a facsimile of one embodiment of the present invention.

It is required that the temperature of the fixing roll 19 of the facsimile 1 be controlled to be a predetermined temperature such that the toner image adhered to the paper P is stably thermal-fixed to the paper P. A temperature control circuit 27 is shown in FIG. 1.

The temperature control circuit 27 comprises a resistor bridge circuit 28, a comparator 29, a switch 30, and a heater 31. The bridge circuit 28 comprises a thermistor TH, which is formed close to the peripheral surface of the fixing roll 19, and three resistors R1 to R3. Voltage data is output to a point B of the resistor bridge circuit 28 in accordance with a voltage-dividing ratio of resistor R1 to the change of the temperature of the fixing roll 19 detected by the thermistor TH. Voltage data is output to an inverting input (hereinafter called—input) of the comparator 29. Moreover, voltage data (voltage value at point A), which is determined by the resistance values of the resistors 2 and 3, is output to a non-inverting input (hereinafter called+input), and used as a reference value of the comparator 29. The reference value is a value for setting the fixing roll 19 to be a predetermined temperature in controlling the temperature of the fixing roll 19. The predetermined temperature corresponds to a first temperature in a first control mode operation to be explained later.

Moreover, a circuit 26, which comprises a transistor Q2 and resistors R4 to R6, is connected to the resistor R2 in parallel. The circuit 26 controls the transistor Q2 to be turned on/off in accordance with a FULOW signal output from the CPU 110 controlling the whole facsimile 1. For example, if the FULOW signal is in a low level, the circuit 26 turns on the transistor Q2 and changes the potential of point A, and also changes the reference value to be output to+input of the comparator 29. In other words, the FULOW signal, which is in the low level, is output, thereby the reference value of the comparator 29 is changed, and the temperature of the fixing roll 19 is set to be a temperature which is a little lower than the predetermined temperature to be explained later. The temperature, which is a little lower than the predetermined temperature, corresponds to a second temperature in a second control mode operation to be explained later.

The comparator 29 outputs a low signal to the transistor Q1 via an NAND gate 32 and a resistor R8 and turns on the transistor Q1 when voltage data to be supplied to−input is higher than the reference value to be supplied to+input, that is, the temperature of the fixing roller 19 is lower than the predetermined temperature (or temperature which is a little lower than the predetermined temperature). Moreover, the comparator 29 outputs a high signal to the NAND gate 32 via a pull-up resistor R7 and turns off the NAND gate 32 and the transistor Q1 when voltage data to be supplied to−input is lower than the reference value to be supplied to+input, that is, the temperature of the fixing roller 19 is higher than the predetermined temperature (or temperature which is a little lower than the predetermined temperature). The FUEN signal to be input to the NAND gate 32 is in a mode which is set by a signal output from the CPU in a third control mode to be explained later. Also, the FUEN signal is output such that the NAND gate 32 is turned off and the current supply to the heater 31 is stopped.

The switch 30 comprises the transistor Q1, an LED 33, a gate trigger circuit 34, and a triode AC switch (TRIAC) 35, and controls the heater 31 to be conductive or non-conductive in accordance with the on/off state of the transistor Q1. For example, if the transistor Q1 is turned on, current flows to the LED 33 via a resistor R10 and the LED 33 is emitted and the gate trigger circuit 34, and the TRIAC 35 are sequentially turned on, thereby the heater 31 is conductive. In other words, an alternating current output from an ac power source 36 is supplied to the heater H. Also, if the transistor Q1 is turned off, the LED 33 is turned off and the trigger circuit 34 and the TRIAC 35 are turned off, so that the current supply to the heater 31 is stopped. The fixing roll 19 is heated while the alternating current is flowing to the heater 31. The current supply to the heater 31 is controlled at a predetermined interval, thereby the temperature of the fixing roll 19 is controlled to be the predetermined temperature (or temperature which is little lower than the predetermined temperature).

The relationship between the temperature of the fixing roll 19 and the operation of the image formation will be explained as follows.

If data is received from the external unit via the telephone line, a starting signal is sent to the CPU 110 of the image forming apparatus from the NCU (network control unit) 100 in order to print-output received data.

If the starting signal is input, a print paper feeding is started, and the image forming operation is started. At this time, if the fixing temperature is in a sleep control state by a LOW sleep mode, the sleep control is released at the same time with the start of the image forming operation, and the fixing temperature control is started by the normal mode. The temperature of the fixing roll 19 start to increase. Then, if the temperature reaches to the fixing set temperature, the fixing process of the paper can be performed.

Due to this, it is required that the temperature of the fixing roll 19 reach to the setting temperature at which the fixing process can be performed by the time when the image forming process is provided in the paper, which starts to be fed at the same time with the input of the starting signal, and the paper reaches to the fixing roll 19. Therefore, the heater is turned on by the time when the paper, which starts to be fed at the same time with the start of the image forming operation, reaches to the fixing roll 19. Then, the control temperature at the time of the LOW sleep mode must be set to be in the range where the temperature of the fixing roll 19 can sufficiently rise up to the setting temperature. In other words, the paper feeding speed (process speed), a distance between the starting position of the paper feeding and the fixing roll 19, heat capability of the fixing heater, heat capacity of the fixing roll, and control temperature setting value at the time of the LOW sleep mode must be designed to satisfy the above-mentioned conditions.

Figure 4:
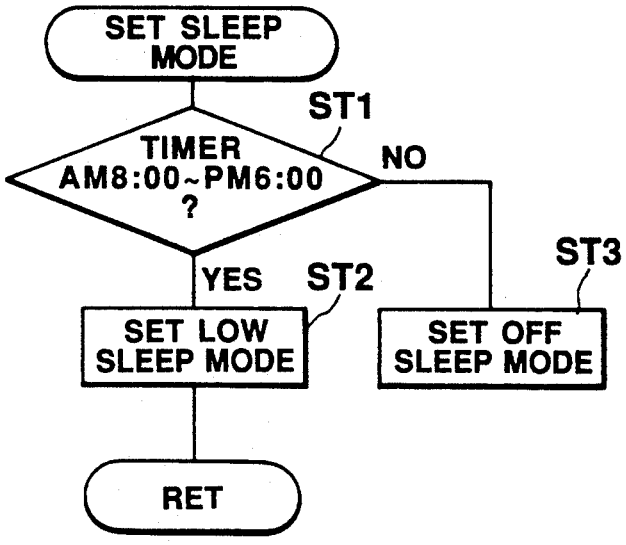
FIG. 4 is a flow chart explaining a first embodiment of a temperature control processing of the fixing roll relating to the present invention.
Figure 5:
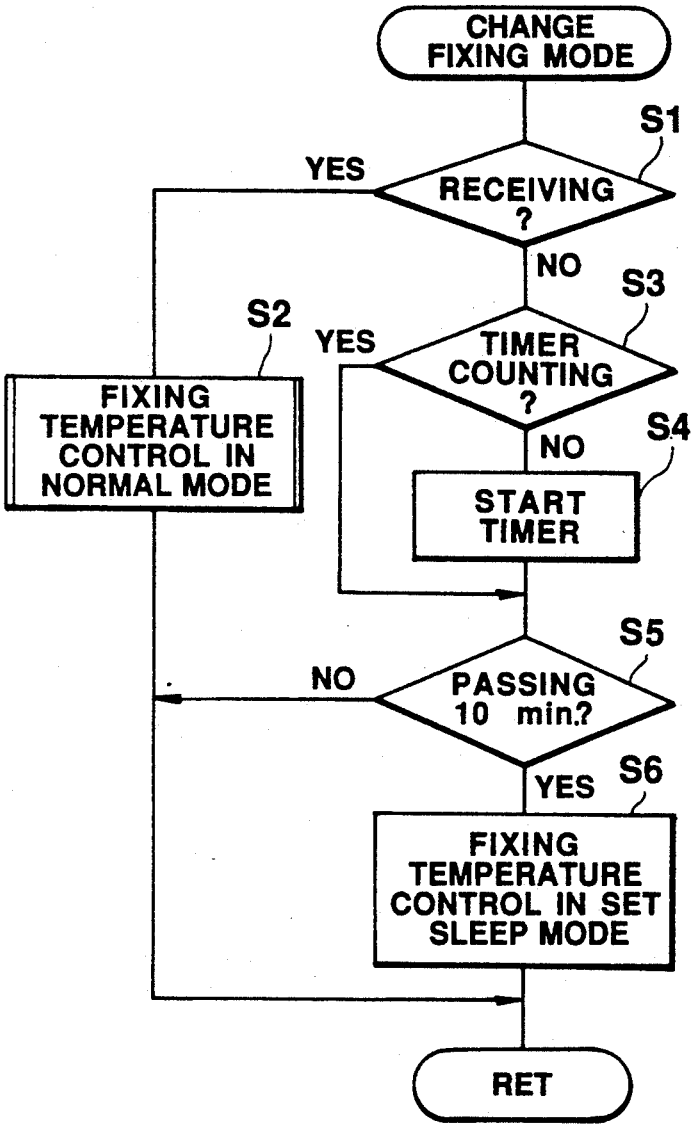
FIG. 5 is a flow chart explaining a second embodiment of the temperature control processing of the fixing roll relating to the present invention.

The flow charts of FIGS. 4 and 5 explain the temperature control process of the fixing roll 19. In this embodiment, the temperature control can be changed to two types of sleep modes, that is, the LOW sleep mode as the second control mode, which controls the temperature to be relatively high (temperature which is a little lower than the predetermined temperature, so that the image forming section 4 can perform the printing process at once in response to the data reception from the telephone line, and the OFF sleep mode as the third control mode, which is not conductive to the fixing roll 19. In the explanation of the flow charts, it is assumed that the using frequency of the facsimile 1 is high during the time zone, 8:00 AM to 6:00 PM, and low during the time zone other than 8:00 AM to 6:00 PM.

FIG. 4 is shows the flow chart explaining the changing process of the above-mentioned sleep mode. This operation is repeated at a predetermined period while the power of the apparatus is turned on. First, it is discriminated whether or not a clock 105, which is provided in the CPU 110 controlling the system control of the facsimile 1, counts the time zone, 8:00 AM to 6:00 PM (Step (hereinafter called ST) 1). The using frequency of the facsimile 1 is high during the time zone, 8:00 AM to 6:00 PM. The time zone, 8:00 AM to 6:00 PM, is set by the user's operation of the setting switch. If it is discriminated that the time zone is 8:00 AM to 6:00 PM in ST1 (ST1 is Yes), the temperature of the fixing roll 19 is set to be in the LOW sleep mode, serving as a second control mode, in ST2. The temperature of the fixing roll 19 is set to be a little lower than the predetermined. In other words, the temperature is controlled such that the printing process can be executed immediately after the facsimile 1 receives the signal. More specifically, the FULOW signal, which is output from the CPU 110, is set to be in a low level, and is output to the transistor Q2 to be turned on. Thereby, a parallel resistor circuit comprising resistors R1 and R2 is formed, and voltage data of the reference value to be output to the comparator 29 is changed by the variation of the combined resistance value with resistor R3, and is set to be higher than the reference value corresponding to the predetermined temperature. By the above-mentioned control, when the output of the comparator 29 turns on the transistor Q1 and controls the temperature of the fixing roll 19, the temperature of the fixing roll 19 is controlled to be lower than the predetermined temperature.

On the other hand, if it is discriminated that the time zone is other than 8:00 AM to 6:00 PM in ST1 (ST1 is No), the temperature of the fixing roll 19 is set to be in the OFF sleep mode, serving as a third control mode, in ST3. The temperature of the fixing roll 19 is set to the temperature at which the fixing roll 19 is not heated. More specifically, the FUEN signal, which is output from the CPU 110, is set to be in a low level, and is output to the NAND gate 32 to be turned off. Thereby, the transistor Q1 is turned off, and current supply to the heater H is stopped. By the above control, since the fixing roll 19 is not heated, the temperature of the fixing roll 19 is set to be in an extremely low. However, there is no problem since the facsimile 1 is little used during the time zone, 6:00 PM to 8:00 AM in the next morning. However, even in the OFF sleep mode, the main power is turned on and the receiving signal can be received.

By the above temperature control of the fixing roll 19, the power consumption of power of the facsimile 1 can be largely reduced during the time zone, 6:00 PM to 8:00 AM in the next morning.

If the data transmitting and receiving process is performed at the time of either the LOW sleep mode or the OFF sleep mode, the output of the FULOW signal and the FUEN signal are stopped during that time. The comparator 29 controls the temperature of the fixing roll 19 to be in the predetermined temperature based on the comparison between voltage data partially divided by the resistors R2 and R3 and the reference value. This state corresponds to the first control mode, that is, a state in which the step (hereinafter called S) 1 shown in FIG. 5 is Yes, and a step S2 is executed. Due to this, in this state, the temperature of the fixing roll 19 is controlled to be a suitable temperature for a printing process.

If the printing process ends (if the receiving process ends, S1 is No), it is discriminated whether or not the timer (not shown) is counting time in S3. It is noted that the timer is not counting time (S3 is No) when S3 is executed for the first time since the printing process ends. Due to this, a timer start process (S4) is executed, and it is discriminated whether or not ten minutes has passed (S5). It is noted that the first time process in the discrimination in S5 is No. Thereafter, the timer repeats the time counting process, and if it is discriminated that ten minutes has passed from the timer start, S5 is Yes and the temperature control of the fixing roll 19 is changed to be in the above-set sleep mode in S6. Then, the timer is automatically reset after ending ten minutes' time counting process.

According to the above-mentioned embodiment, if the non-receiving state continues for a predetermined time, the temperature control of the fixing roll 19 is changed to either the OFF mode sleep mode or the LOW sleep mode, depending on whether or not the present time is a time zone, which is determined in advance. However, the present invention is not limited to the above-mentioned method. In a case where the present time, which is counted by the clock 105 is in the time zone other than the predetermined time zone of highly using frequency, the temperature control is immediately changed to the OFF sleep mode control as the non-receiving state continues for the predetermined time. In a case where the present time is in the predetermined time zone, the temperature control is once executed in the LOW sleep mode. Then, if such a temperature control continues for a predetermined time, the temperature control is changed to be in the OFF sleep mode. As mentioned above, a two-stepped mode change control may be executed.

Figure 6:
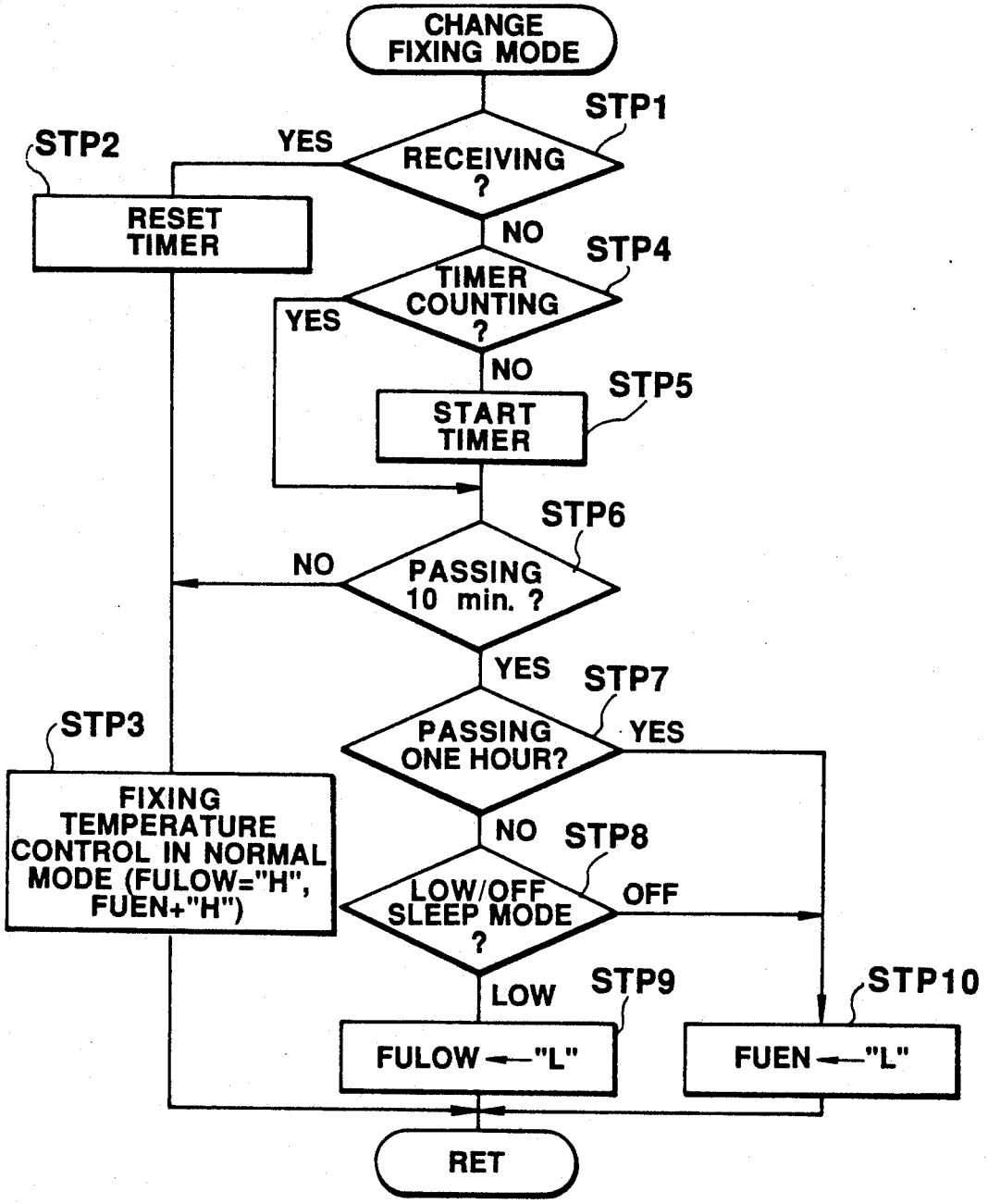
FIG. 6 is a flow chart explaining a first modification of the embodiment of FIG. 4.

The above control will be explained with reference to FIG. 6.

First, in step (hereinafter called STP) 1, it is discriminated whether or not data is receiving. If data is receiving, the timer is reset in STP2, and the fixing temperature control is executed in a normal mode in STP3. At this time, the FULOW signal and the FUEN signal are in an "H" level.

On the other hand, if data is receiving, it is discriminated whether or not the timer is counting time in STP4. If the timer is counting time, it is discriminated whether or not ten minutes has passed. If the timer is not counting time, the timer is started in STP5, and it is discriminated whether or not ten minutes has passed in STP6. If ten minutes has not yet passed, STP3 is executed. If ten minutes has passed, it is discriminated whether or not one hour has passed in STP7. If one hour has passed, the FUEN signal is set to be in an "L" level, and the mode is set to be in the OFF sleep mode in STP10.

If one hour has not passed, it is discriminated whether the sleep mode is LOW or OFF at present in STP8. If the sleep mode is LOW, the FULOW signal is set to be in the "L" level in STP9, and if the sleep mode is OFF, the FUEN signal is set to be in the "L" level in STP10.

According to the above embodiment, the change of the OFF sleep mode and the LOW sleep mode is executed depending on whether or not the present time corresponds to the time zone of highly using frequency predetermined by the operator. However, the present invention is not limited to the above embodiment. The other embodiments will be explained.

The method of the first other embodiment is that there is used a peripheral luminous energy sensor detecting peripheral luminous energy of the facsimile. In other words, the lightness of the periphery of the facsimile is discriminated by the peripheral luminous energy sensor, so that it is discriminated whether an office where the facsimile is mounted is light or dark (if the office is light, people are working, and the using frequency is high, and if the office is dark, the using frequency is low since it is not a working time zone). In accordance with the peripheral luminous energy, it is discriminated whether the temperature control of the fixing roll in the OFF sleep mode or the LOW sleep mode.

Figure 7:
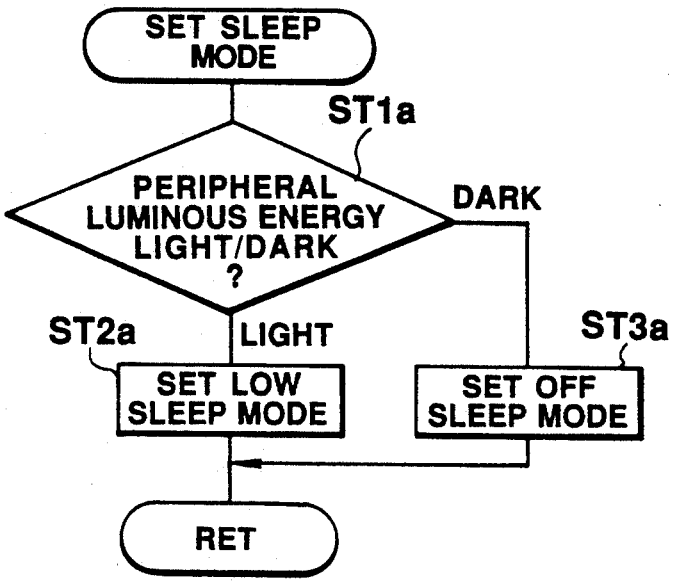
FIG. 7 is a flow chart explaining a second modification of the embodiment of FIG. 4.

The above-mentioned control will be explained with reference to FIG. 7.

In step ST1*a*, the lightness is discriminated based on the peripheral luminous energy by a peripheral luminous energy sensor 107. If the office where the facsimile is mounted is light, the temperature control is set to be in the LOW sleep mode in step ST2*a*. and if it is dark, the temperature control is set to be in the OFF sleep mode in ST3*a*.

The method of the second other embodiment is that there is used a peripheral noise sensor 108 measuring noise of the periphery of the facsimile. In other words, even if there is a little noise in the periphery of the facsimile, people are working and it is a working time zone in which the facsimile is also working. If there is no noise in the periphery of the facsimile, people are not working and it is a time zone in which the necessity of the facsimile is low. Due to this, the temperature control of the fixing roll 19 can be changed in accordance with the result of the above discrimination.

Figure 8:
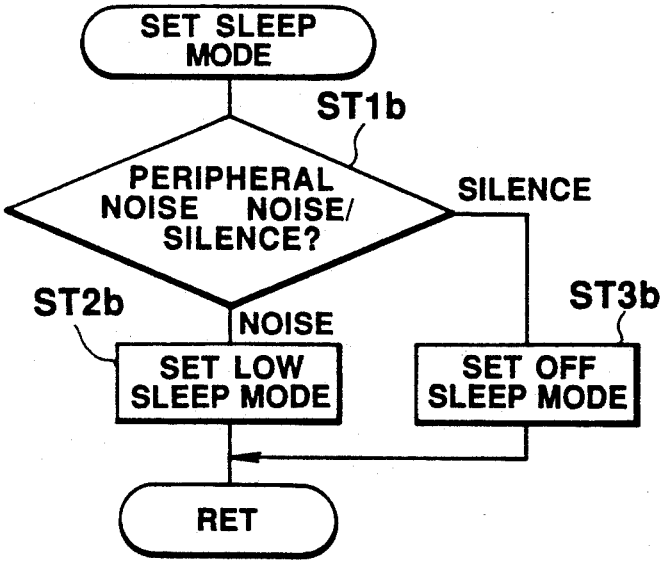
FIG. 8 is a flow chart explaining a third modification of the embodiment of FIG. 4.

The above-mentioned control will be explained with reference to FIG. 8.

In step ST1*b*, the peripheral noise is measured by the peripheral noise sensor 108. If there is "NOISE", the temperature control is set to be in the LOW sleep mode in ST2*b*, and if it is "SILENCE", the temperature control is set to be in the OFF sleep mode in ST3*b*.

The sensor to be used in this embodiment is not limited to the above-mentioned peripheral noise sensor. It is off course that the similar control can be executed if a human sensing sensor, which can discriminate whether or not people exist around the facsimile, is used.

Moreover, in order to cope with the international communication using the facsimile, the following method can be used:

First, a name of a certain country is designated and the working time zone of each of the other countries is automatically selected. Then, the present time of the designated country compared with the working time zone of the selected country. Thereafter, it is discriminated whether or not the present time of the designated country corresponds to the working time zone of the selected country. Thereby, similar to the above-mentioned embodiments, the temperature control mode of the fixing roll 19 may be changed.

Figure 9:
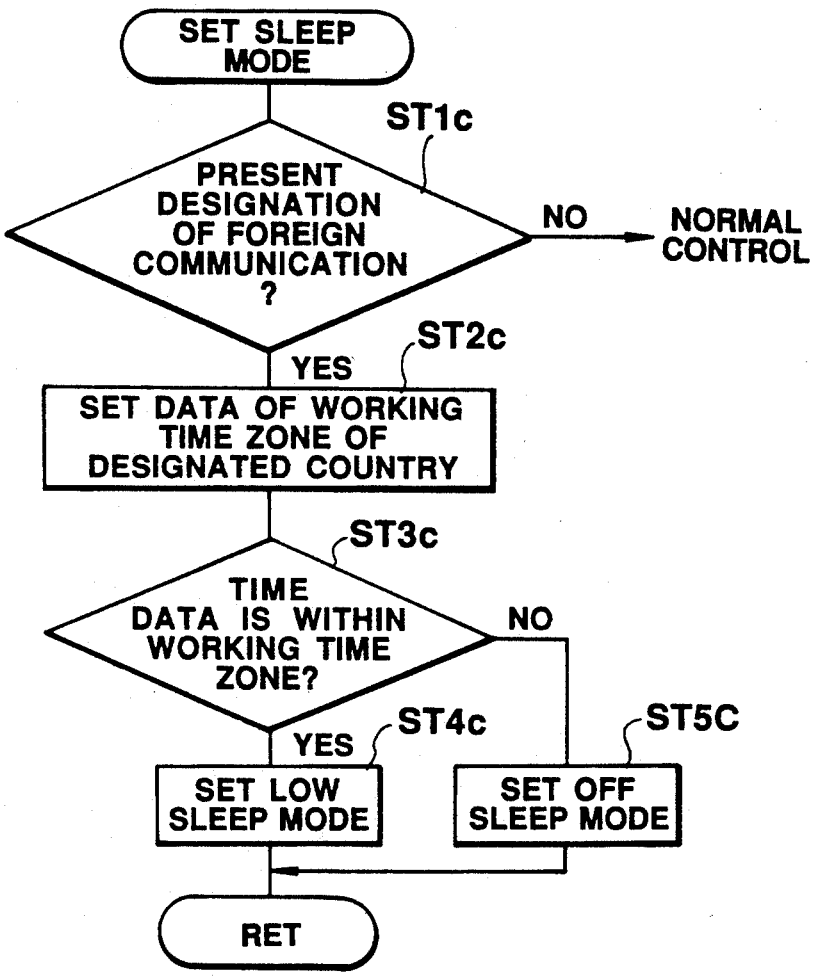
FIG. 9 is a flow chart explaining a fourth modification of the embodiment of FIG. 4.

The control of the above method will be explained with reference with FIG. 9.

In ST1C, it is discriminated whether or not there is a designation of a foreign communication. If there is not the designation, the normal control is performed. If there is, data of the working time zone of the designated country is read from the ROM 102 and input to the working time zone setting circuit 104 in ST2C. Next, time data, which is output by the clock 105, is compared with time zone data set in the working time zone setting circuit 104, and it is discriminated whether or not time data, which is output by the clock, is within the working time zone in ST3C. If time data is within the working time zone, the temperature control is set to be in the LOW sleep mode, and if time data is not with the working time zone, the temperature control is set to be in the OFF sleep mode in ST5C.

Furthermore, the following method may be used.

There is provided an environmental temperature sensor detecting the temperature of the periphery of the apparatus. It is discriminated whether or not the periphery of the apparatus is warm in accordance with the environmental temperature of the place where the apparatus is provided, and two-stepped change of the sleep mode is executed. If it is a little cold, the temperature control is executed in the LOW sleep mode only in the non-working time zone. If it is extremely cold, neither OFF sleep mode nor LOW sleep mode may be set.

Figure 10:
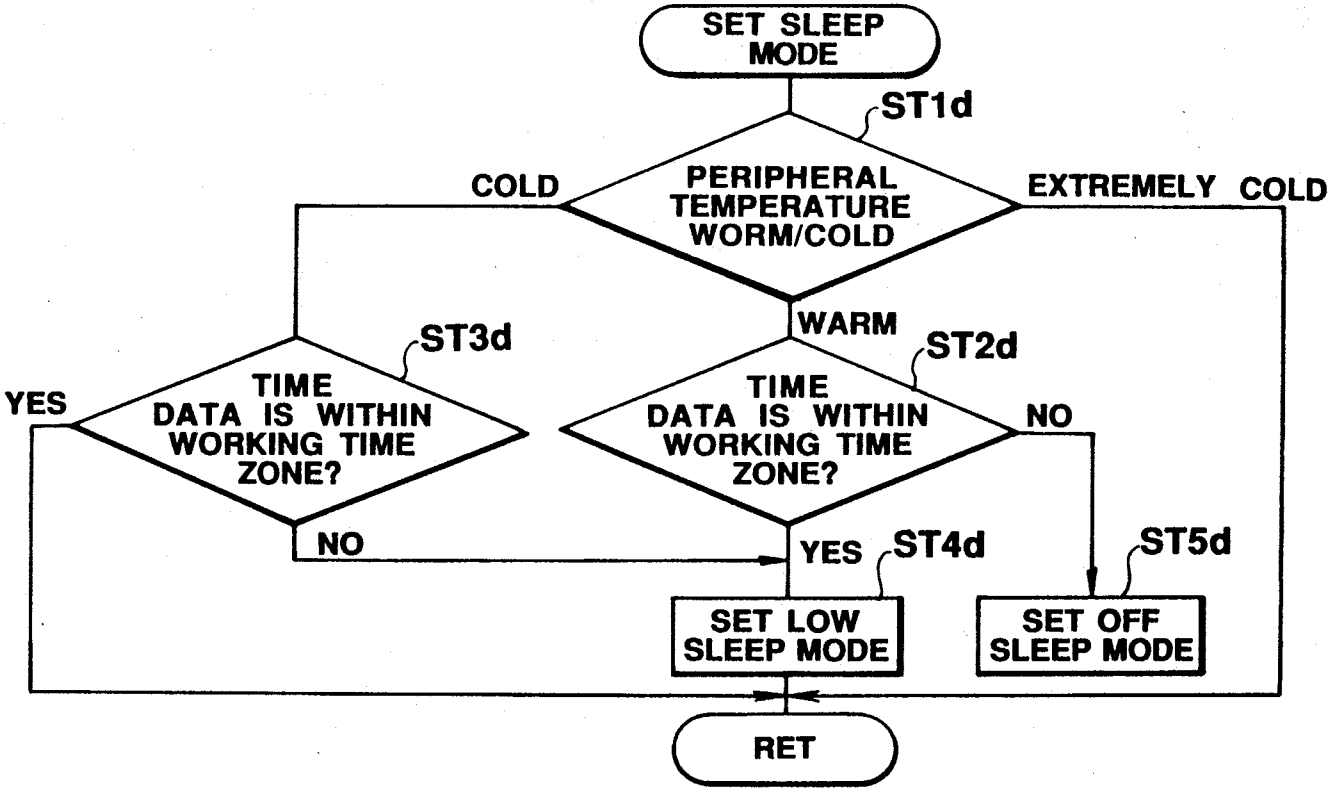
FIG. 10 is a flow chart explaining a first modification of the embodiment of FIG. 5.

The control of the above method will be explained with reference with FIG. 10.

In ST1d, it is discriminated whether the periphery of the apparatus is "COLD" or "WARM" based on the temperature of the periphery of the apparatus. If it is "WARM", time data, which is output by the clock 105, is compared with time zone data set in the working time zone setting circuit 104, and it is discriminated whether or not time data, which is output by the clock, is within the working time zone in ST2*d*. If time data is out of the working time zone, the temperature control is set to be in the OFF sleep mode in ST5*d* and the step is returned to the first step. If time data is within the working time zone, the temperature control is set to be in the LOW sleep mode in ST4*d* and the step is returned to the first step.

On the other hand, the periphery of the apparatus is "COLD", it is discriminated whether or not time data, which is output by the clock, is within the working time zone in ST3*d*. If time data is out of the working time zone, the temperature control is set to be in the LOW sleep mode. If time data is within the working time zone, the step is returned to the first step, and the above steps are repeated.

Moreover, if it is discriminated that the periphery of the apparatus is "EXTREMELY COLD", neither OFF sleep mode nor LOW sleep mode may be set.

The temperature of the fixing roll 19 is controlled as mentioned above, the printable state can be set immediately by the input of the transmitting signal in the time zone in which the using frequency of the facsimile 1 is high. The fixing roll 19 is not heated in the time zone in which the using frequency of the facsimile 1 is extremely low, so that consumption of power can be saved.

According to the above embodiments, the sleep mode is selected in accordance with time. However, the sleep mode is not limited to time. The sleep mode may be changed in accordance with a calendar, that is, the unit of a date, and a day of the week.

Moreover, in the above embodiments, the facsimile was explained as an example of the image forming apparatus. However, it is, of course, possible to apply the present invention to the other image forming apparatuses such as an electrophotographic printer.

According to the present invention, two types of sleep mode can be selected in accordance with the frequency of the start of the image printing operation. Due to this, consumption of power is not wastefully used, and the lifetime of the thermal fixing relating members such as the fixing roll and the heater can be prolonged.

Moreover, the OFF sleep mode control is performed during only the period of which the frequency of the start is low. Due to this, unlike the conventional image forming apparatus, the memory having a large capacity is not needed, and the memory having relatively a small capacity may be used. Due to this, the manufacturing cost of the apparatus can be reduced.

Furthermore, since the start and rise time is short at the time of the start receiving signals for the period of time when the signal receiving frequency is high, there can be realized the image forming apparatus with a good processing efficiency.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

a thermal fixing apparatus having a heat generating member for heat-fixing an image on paper;

means for discriminating one of at least two frequency of use periods for said image forming apparatus;

timer means for measuring a non-image forming operation period from the end of an image forming operation performed by said image forming apparatus; and means for controlling a heat-fixing temperature having a first temperature control mode maintaining the temperature of said thermal fixing apparatus at a first temperature at which said image can be fixed, a second temperature control mode maintaining the temperature of said thermal fixing apparatus at a second temperature, which is lower than the first temperature by a predetermined temperature, and a third temperature control mode removing current supply to the heat generating member of said thermal fixing apparatus, wherein said heat-fixing temperature control means selects said second control mode or said third control mode in accordance with an output of said frequency discriminating means after said timer means counts for a predetermined period of time while said heat-fixing temperature control means is operating in said first temperature mode.

2. An image forming apparatus according to claim 1, wherein said means for discriminating determines whether said image forming apparatus is used during high frequency of use hours designated as hours in which the frequency of use of said image forming apparatus is high, or low frequency of use hours designated as hours in which the frequency of use is low.

3. The image forming apparatus according to claim 1, wherein said predetermined temperature is determined after the image forming operation begins, in accordance with a relationship in which the time required for returning the temperature of said thermal fixing apparatus from said second temperature to said first temperature by applying heat thereto is substantially the same as the period of time from start of the image forming operation to when a sheet of paper reaches said thermal fixing apparatus.

4. The image forming apparatus according to claim 1, wherein said heat-fixing temperature controlling means includes means for selecting said third temperature control mode when said timer means counts for a predetermined period of time after said heat-fixing temperature controlling means selects said second temperature control mode in accordance with discrimination of a low frequency of use period by said frequency discriminating means.

5. An image forming apparatus comprising:

a thermal fixing apparatus having a heat generating member for heat-fixing an image on paper;

means for discriminating a frequency of use of said image forming apparatus; and means for controlling a heat-fixing temperature having a first temperature control mode maintaining the temperature of said thermal fixing apparatus at a first temperature at which said image can be fixed, a second temperature control mode maintaining the temperature of said thermal fixing apparatus at a second temperature lower than the first temperature by a predetermined temperature, and a third temperature control mode removing power to the heat generating member of said thermal fixing apparatus, wherein said heat-fixing temperature control means selects one of said second and third control modes in accordance with an output of said frequency discriminating means when a non-image forming operation period continues for a predetermined period of time while said fixing temperature control means is operating in said first temperature mode, and wherein said heat-fixing temperature controlling means includes means for selecting said second temperature control mode when said output of said frequency discriminating means is a signal denoting a time zone corresponding to a high frequency of use, and for selecting said third temperature control mode when said output of said using frequency discriminating means is a signal denoting a time zone corresponding to a low frequency of use.

6. The image forming apparatus according to claim 1, wherein said image forming apparatus includes a facsimile.

7. The image forming apparatus according to claim 1, wherein said image forming apparatus further includes means for generating a starting signal to receive data from an external unit and start the image forming operation.

8. An image forming apparatus comprising:

a thermal fixing apparatus having a heat generating member for heat-fixing an image on paper;

means for discriminating a frequency of use of said image forming apparatus; and means for controlling a heat-fixing temperature having a first temperature control mode maintaining the temperature of said thermal fixing apparatus at a first temperature at which said image can be fixed, a second temperature control mode maintaining the temperature of said thermal fixing apparatus at a second temperature lower than the first temperature by a predetermined temperature, and a third temperature control mode removing power to the heat generating member of said thermal fixing apparatus, wherein said heat-fixing temperature control means selects one of said second and third control modes in accordance with an output of said frequency discriminating means when a non-image forming operation period continues for a predetermined period of time while said fixing temperature control means is operating in said first temperature mode, and wherein said frequency discriminating means includes time zone setting means for predetermining the time zone relating to the frequency of use, timer means for timing the present time, and discriminating means for discriminating whether or not the present time recorded by said timer means is included in the time zone set by said time zone setting means.

9. An image forming apparatus comprising:

a thermal fixing apparatus having a heat generating member for heat-fixing an image on paper;

means for discriminating a frequency of use of said image forming apparatus; and means for controlling a heat-fixing temperature having a first temperature control mode maintaining the temperature of said thermal fixing apparatus at a first temperature at which said image can be fixed, a second temperature control mode maintaining the temperature of said thermal fixing apparatus at a second temperature lower than the first temperature by a predetermined temperature, and a third temperature control mode removing power to the heat generating member of said thermal fixing apparatus, wherein said heat-fixing temperature control means selects one of said second and third control modes in accordance with an output of said frequency discriminating means when a non-image forming operation period continues for a predetermined period of time while said fixing temperature control means is operating in said first temperature mode, and wherein said frequency discriminating means includes luminous energy detecting means for detecting lightness of the periphery of the apparatus.

10. An image forming apparatus comprising:

a thermal fixing apparatus having a heat generating member for heat-fixing an image on paper;

means for discriminating a frequency of use of said image forming apparatus; and means for controlling a heat-fixing temperature having a first temperature control mode maintaining the temperature of said thermal fixing apparatus at a first temperature at which said image can be fixed, a second temperature control mode maintaining the temperature of said thermal fixing apparatus at a second temperature lower than the first temperature by a predetermined temperature, and a third temperature control mode removing power to the heat generating member of said thermal fixing apparatus, wherein said heat-fixing temperature control means selects one of said second and third control modes in accordance with an output of said frequency discriminating means when a non-image forming operation period continues for a predetermined period of time while said fixing temperature control means is operating in said first temperature mode, and wherein said frequency discriminating means includes noise detecting means for detecting noise near the periphery of the apparatus.

11. An image forming apparatus comprising:

a thermal fixing apparatus having a heat generating member for heat-fixing an image on paper;

means for discriminating a frequency of use of said image forming apparatus; and means for controlling a heat-fixing temperature having a first temperature control mode maintaining the temperature of said thermal fixing apparatus at a first temperature at which said image can be fixed, a second temperature control mode maintaining the temperature of said thermal fixing apparatus at a second temperature lower than the first temperature by a predetermined temperature, and a third temperature control mode removing power to the heat generating member of said thermal fixing apparatus, wherein said heat-fixing temperature control means selects one of said second and third control modes in accordance with an output of said frequency discriminating means when a non-image forming operation period continues for a predetermined period of time while said fixing temperature control means is operating in said first temperature mode, and wherein said frequency discriminating means includes region designating means for designating a specific region of each country, storing means for storing the time zone relating to the frequency of use of the apparatus in said specific region of each country, timer means for timing the present time, and discriminating means for discriminating whether or not the present time recorded by said timer means is included in the time zone set by said time zone setting means.

12. An image forming apparatus comprising:

a thermal fixing apparatus having a heat generating member for heat-fixing an image on paper;

means for discriminating a frequency of use of said image forming apparatus; and means for controlling a heat-fixing temperature having a first temperature control mode maintaining the temperature of said thermal fixing apparatus at a first temperature at which said image can be fixed, a second temperature control mode maintaining the temperature of said thermal fixing apparatus at a second temperature lower than the first temperature by a predetermined temperature, and a third temperature control mode removing power to the heat generating member of said thermal fixing apparatus, wherein said heat-fixing temperature control means selects one of said second and third control modes in accordance with an output of said frequency discriminating means when a non-image forming operation period continues for a predetermined period of time while said fixing temperature control means is operating in said first temperature mode, and wherein said heat-fixing temperature control means includes environmental temperature detecting means, and means for selecting one of said first, second, third temperature control modes in accordance with the environmental temperature detected by said environmental temperature detecting means and the output of said frequency discriminating means.

* * * * *